US011788815B2

(12) United States Patent
Connolly

(10) Patent No.: US 11,788,815 B2
(45) **Date of Patent: *Oct. 17, 2023**

(54) OPEN FRAME REFLEX PIVOT MECHANICS

(71) Applicant: Raytheon Canada Limited, Ottawa (CA)

(72) Inventor: John M. Connolly, Ontario (CA)

(73) Assignee: Raytheon Canada Limited

( * ) Notice: Subject to any disclaimer, the term of this patent is extended or adjusted under 35 U.S.C. 154(b) by 0 days.

This patent is subject to a terminal disclaimer.

(21) Appl. No.: 17/505,459

(22) Filed: Oct. 19, 2021

(65) Prior Publication Data

US 2022/0178653 A1 Jun. 9, 2022

Related U.S. Application Data

(63) Continuation of application No. 16/753,309, filed as application No. PCT/CA2017/051197 on Oct. 6, 2017, now Pat. No. 11,150,051.

(51) Int. Cl.

| | |
|---|---|
| ***F41G 1/30*** | (2006.01) |
| ***F41G 1/387*** | (2006.01) |
| *F41G 1/16* | (2006.01) |
| *F41G 1/34* | (2006.01) |
| *F41G 1/467* | (2006.01) |
| *F41G 11/00* | (2006.01) |

(52) U.S. Cl.

CPC ..... *F41G 1/30* (2013.01); *F41G 1/387* (2013.01); *F41G 1/16* (2013.01); *F41G 1/345* (2013.01); *F41G 1/467* (2013.01); *F41G 11/003* (2013.01)

(58) Field of Classification Search

CPC ..... F41G 1/30

USPC ..... 42/113, 132

See application file for complete search history.

(56) References Cited

U.S. PATENT DOCUMENTS

| | | | | |
|---|---|---|---|---|
| 5,483,362 | A | 1/1996 | Tai et al. | |
| 5,577,326 | A | 11/1996 | Montelin | |
| 5,625,954 | A | 5/1997 | DePaoli | |
| 5,653,034 | A | 8/1997 | Bindon | |
| 5,813,159 | A | 9/1998 | Kay et al. | |
| 8,099,897 | B2 | 1/2012 | Elpedes et al. | |
| 8,671,611 | B2 | 3/2014 | Ostergren et al. | |
| 8,984,795 | B2 | 3/2015 | Jung et al. | |
| 11,150,051 | B2 * | 10/2021 | Connolly | F41G 1/30 |
| 2014/0096431 | A1 | 4/2014 | Tang | |

(Continued)

OTHER PUBLICATIONS

Extended European Search Report dated Mar. 22, 2021, in EP Application No. 17928067.2 filed Oct. 6, 2017, 7 pages.

*Primary Examiner* — Reginald S Tillman, Jr.

(57) ABSTRACT

A reflex sight to sight a weapon, such as a firearm, comprises a frame carried by a base. The frame carries a mirror and an illumination source, such as an LED, spaced-apart and in a fixed relationship with respect to one another with the illumination source directed towards the mirror at a fixed orientation. A spindle is carried by the frame and disposed between the frame and the base about which an orientation of the frame with respect to the base is adjusted. The spindle has a vertical shaft extending between the base and the frame, with the frame capable of swiveling horizontally on the vertical shaft to adjust for azimuth. The spindle also has a horizontal axle extending between the vertical shaft and the frame, with the frame vertically pivotal on the horizontal axle to adjust for elevation.

18 Claims, 8 Drawing Sheets

(56) References Cited

U.S. PATENT DOCUMENTS

| | | | |
|---|---|---|---|
| 2016/0102943 | A1 | 4/2016 | Teetzel et al. |
| 2016/0245618 | A1 | 8/2016 | Collin et al. |
| 2016/0327366 | A1 | 11/2016 | Campean |

* cited by examiner

OPEN FRAME REFLEX PIVOT MECHANICS

RELATED APPLICATION

This is a continuation application of U.S. application Ser. No. 16/753,309, filed Apr. 2, 2020, entitled "Open Frame Reflex Pivot Mechanics", which is the national phase filing under 35 U.S.C. 371 of PCT Application No. PCT/CA2017/051197, filed Oct. 6, 2017, and entitled, "Open Frame Reflex Pivot Mechanics", each of which is incorporated by reference in its entirety herein.

BACKGROUND

A reflex sight is used on a firearm to sight the barrel. The reflex sight is an optic with a partially reflecting window with an illuminated projection, such as a dot or cross-hairs or reticle or the like. Thus, a user can look through the window and see the target with the illuminated projection superimposed thereon. The sight utilizes the optical principle that the illuminated projection at the focus of the window, or lens or curved mirror thereof, will appear as if it is in front of the sight at infinity, or a predetermined focal distance to which a minimal parallax is achieved, such as 75 m-100 m focal distance for combat applications for a better compromise for parallax control. The window includes a lens or curved mirror which allows the illuminated projection to be reflected while allowing the user to see the target. The illuminated projection can be projected with a light emitting diode (LED) or diode. Such sights often have adjustments to manipulate the diode and the window with respect to one another to provide boresight alignment or correction. The window, or lens or curved mirror thereof, and the diode are designed to provide a desired optical performance, and moving one with respect to the other can introduce parallax errors. While certain changes to the window or mirror geometry and additional elements can compensate for the performance losses due to intentionally moving the diode out of alignment, optical performance cannot be restored.

Some sights use an inner and outer tube design that is able to maintain the diode-to-mirror relationship, but creates a "tube-effect" for the user. For example, see U.S. Pat. No. 5,577,326. In addition, such tube-in-tube designs are typically not used for "mini" reflect sights, such as small-arms, because the tube-effect is amplified when combined with a small field of view.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
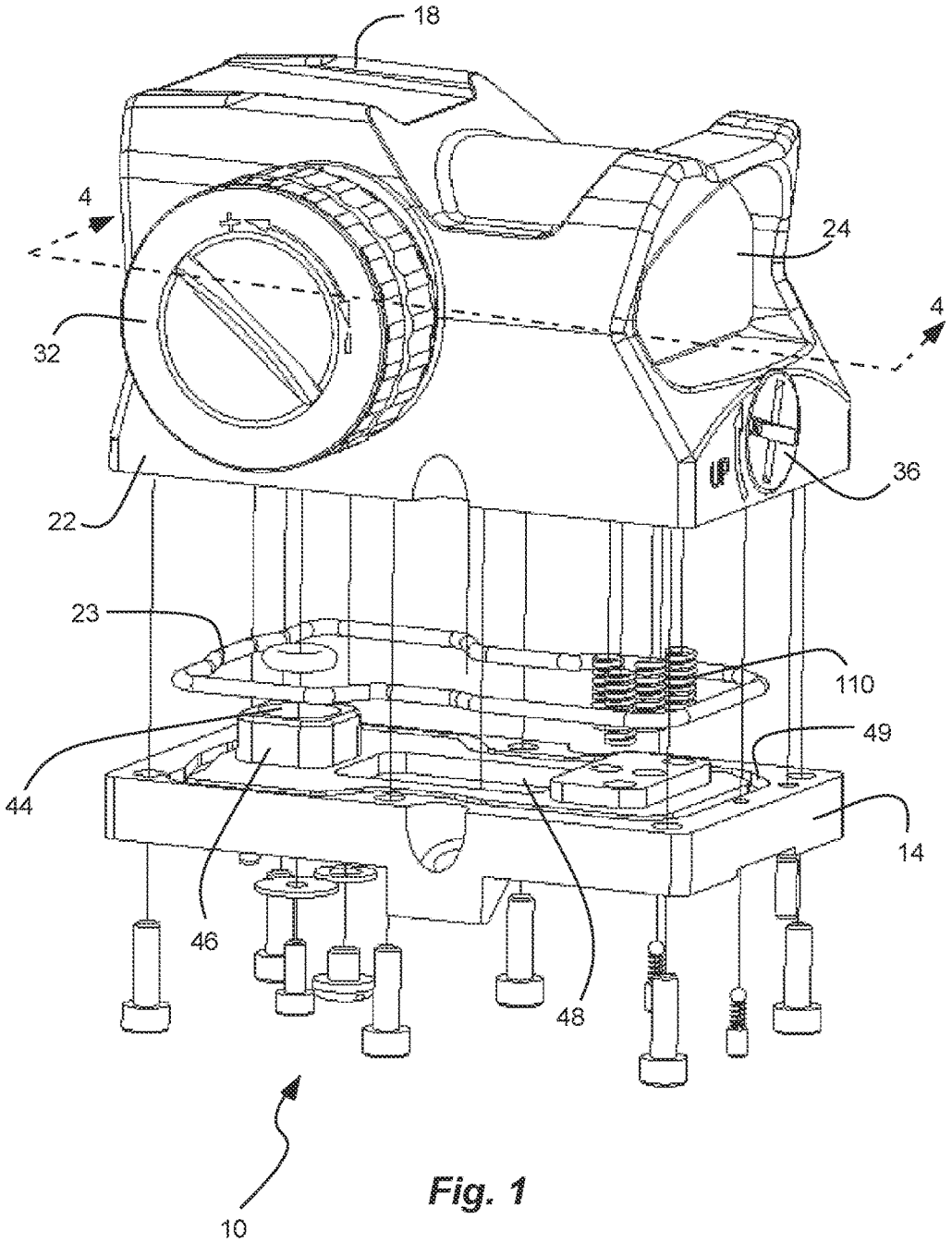
FIG. 1 is an exploded perspective view of a reflex sight in accordance with an example.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Disclosed herein is a reflex sight. The reflex sight can be mounted on a weapon. In one aspect, the weapon can be a firearm, such as a rifle or handgun. Thus, the reflex sight can be sized for small arms, such as those carriable by a person. As another example, the reflex sight can be sized for larger arms, such as vehicle mounted weapons. In another aspect, the weapon can be an archery bow or cross-bow. In another aspect, the reflex sight can be sized and shaped for other sporting optics, such as scopes, spotting scopes, and the like.

The reflex sight has a diode and mirror to be mounted on a single and/or common frame, wherein the reflex sight allows for bore sighting without affecting the relationship of the diode to the mirror. The single frame allows for very accurate mechanical alignment and location. Maintaining the optical relationship of the diode to the mirror ensures the best optical performance, and greatly reduces the potential for parallax errors. The reflex sight allows for independent bore sight elevation and azimuth adjustment without moving the diode off the optical axis with respect to the mirror. By moving the diode and mirror together, the optical performance is not compromised due to bore sight adjustments, and part count can also be reduced.

The sight has pivot mechanics that are integral to the frame for accurate location of the pivot position to the mirror and the diode. The pivot mechanics can be either direct or indirect drive as the pivot mechanics are essentially decoupled. The design of the frame can be lengthened or shortened to accommodate different optical designs, and bore sight mechanics can be used to displace the assembly to affect the point of impact. In addition, the geometry of the frame allows the sight to be either a sealed closed type reflex sight, or an open type reflex sight, with minimal impact to increase the user's field of view. An open reflex design allows a shroud to be modified, reducing weight, cost and the mechanical aperture, to shorten the "tube effect" Furthermore, the single and/or common frame allows the diode and the mirror to be mounted accurately with respect to one another, and to remain accurately mounted. The diode and the mirror can be initially aligned and mounted to the single frame from datum or through active alignment.

FIG. 1 depicts an exploded perspective view of a reflex sight 10 in accordance with an example. The reflex sight 10 comprises a base 14 sized and shaped to be mounted to a weapon. In one aspect, the base 14 can be mounted to a rail of the weapon, such as a Picatinny rail or a Weaver rail. In another aspect, the base 14 can be mounted to a scope or other optic. In another aspect, the base can be mounted or keyed to a top of the weapon, such as a slide of a pistol.

Figure 2:
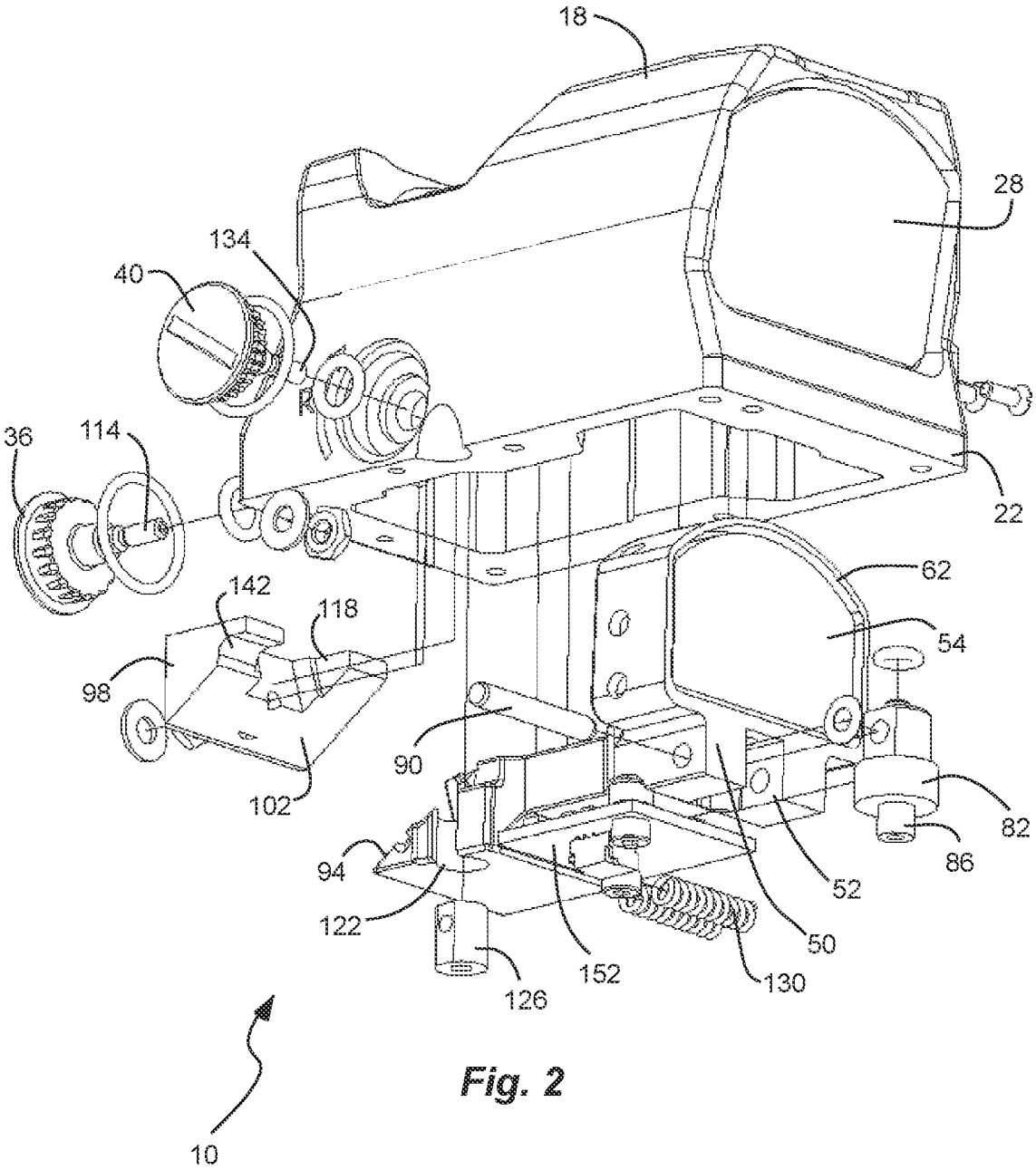
FIG. 2 is a partial exploded perspective view of the reflex sight of FIG. 1, shown with a base removed to expose a frame.

The reflex sight 10 can also have a shroud 18 coupled to, disposed on, or carried by the base 14. The shroud 18 and the base 14 can form and define a housing 22 when joined together. The shroud 18 can be coupled to (e.g., fastened with fasteners (e.g., screws, bolts, adhesive, or others)) to the base 14 extending though a bottom of the base 14 and into the shroud 18. A gasket 23 or other type of seal can be disposed between the base 14 and the shroud 18 to seal the base and the shroud, or the housing. The shroud 18 can have open opposite ends closed by windows or lenses, such as a front or leading window or lens 24, and a rear or trailing window or lens 28 (FIG. 2). Thus, the reflex sight 10 can be a closed sight. The shroud 18 and/or the housing 22 can have a sight axis through which a user looks through the shroud 18 and the housing 22, and the lenses 24 and 28. In addition, the shroud 18, the housing 22, or both, can carry various adjustments, including a battery compartment, brightness control 32, an elevation adjustment knob 36, and an azimuth (or windage) adjustment knob 40 (FIG. 2), a reticle pattern selector, or others as will be apparent to those skilled in the art.

The base 14 can comprise a spindle bore 44 formed therein. The spindle bore 44 can be formed in a protrusion 46 extending from the base 14. In addition, the base 14 can have a recess 48 formed therein and facing the shroud 18. Furthermore, a channel 49 can be formed in the base 14 to receive the gasket 23. Similarly, a channel can be formed the shroud 18 to receive the gasket 23.

In one aspect, the base 14 can be formed of metal, and can be formed by machining. Similarly, the shroud 18 can be formed of metal, and can be formed by machining. In another aspect, the shroud 18 can be formed of plastic, and can be formed by injection molding or other manufacturing process.

FIG. 2 depicts a partial exploded perspective view of the reflex sight 10, shown with the base removed from the shroud 18 to expose a frame 50. The shroud 18 can have the rear lens 28 closing an opening opposite the front lens. In addition, the shroud 18 and/or the housing 22 can carry the azimuth (or windage) adjustment knob 40. The frame 50 can have a yoke 52 formed therein opposing the spindle bore 44 (FIG. 1). The frame 50 can be received in the shroud 18. In one aspect, the shroud 18 can be sealed, with the lenses 24 and 28 sealed over the open ends. In addition, the various adjustments, such as the battery compartment or brightness control 32, the elevation adjustment knob 36, and the azimuth (or windage) adjustment knob 40 (FIG. 2), can extend through bores in the shroud 18, and can be sealed, such as with o-rings.

Figure 3:
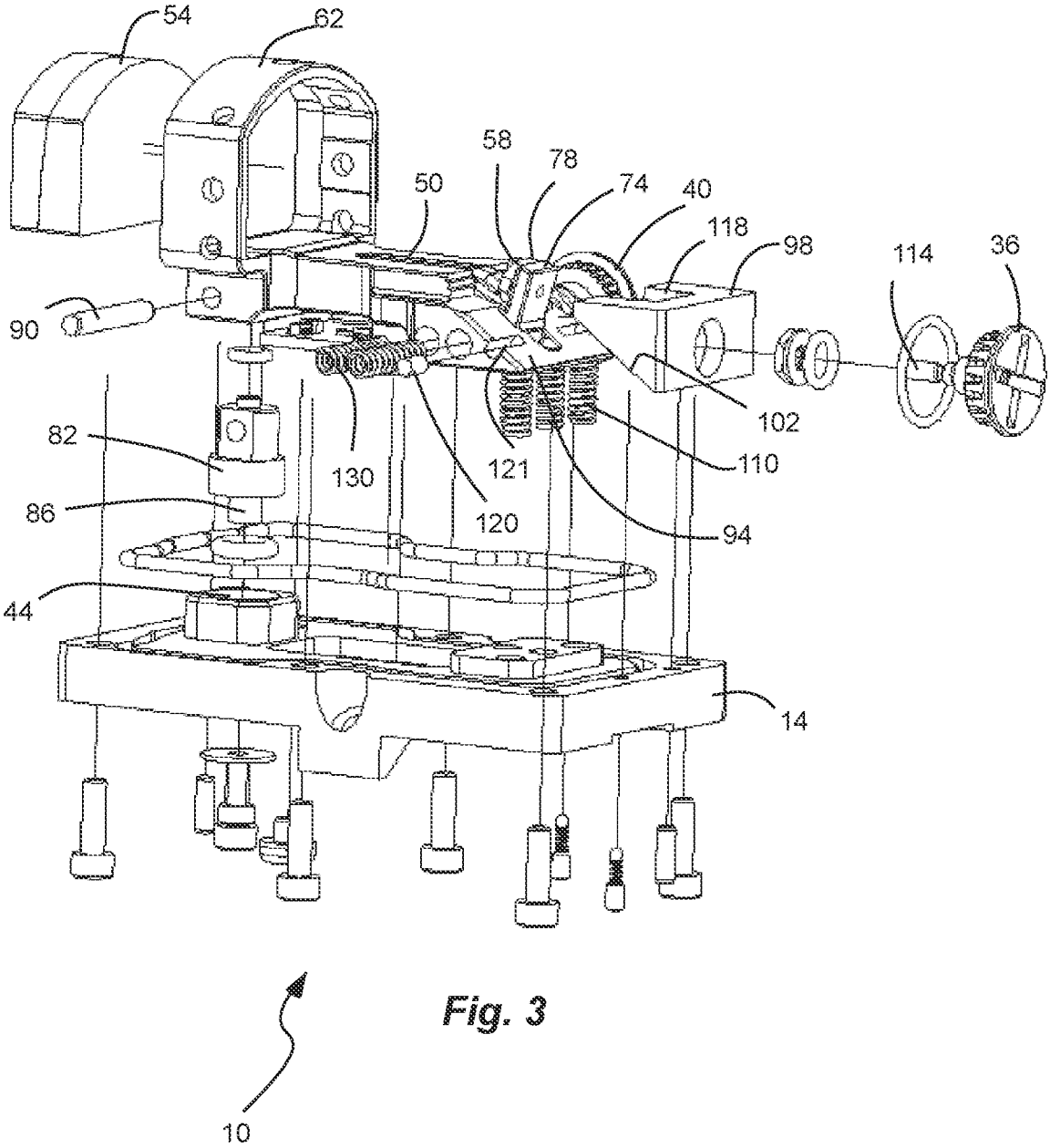
FIG. 3 is a partial exploded view of the reflex sight of FIG. 1, shown with a shroud removed to expose the frame.
Figure 4:
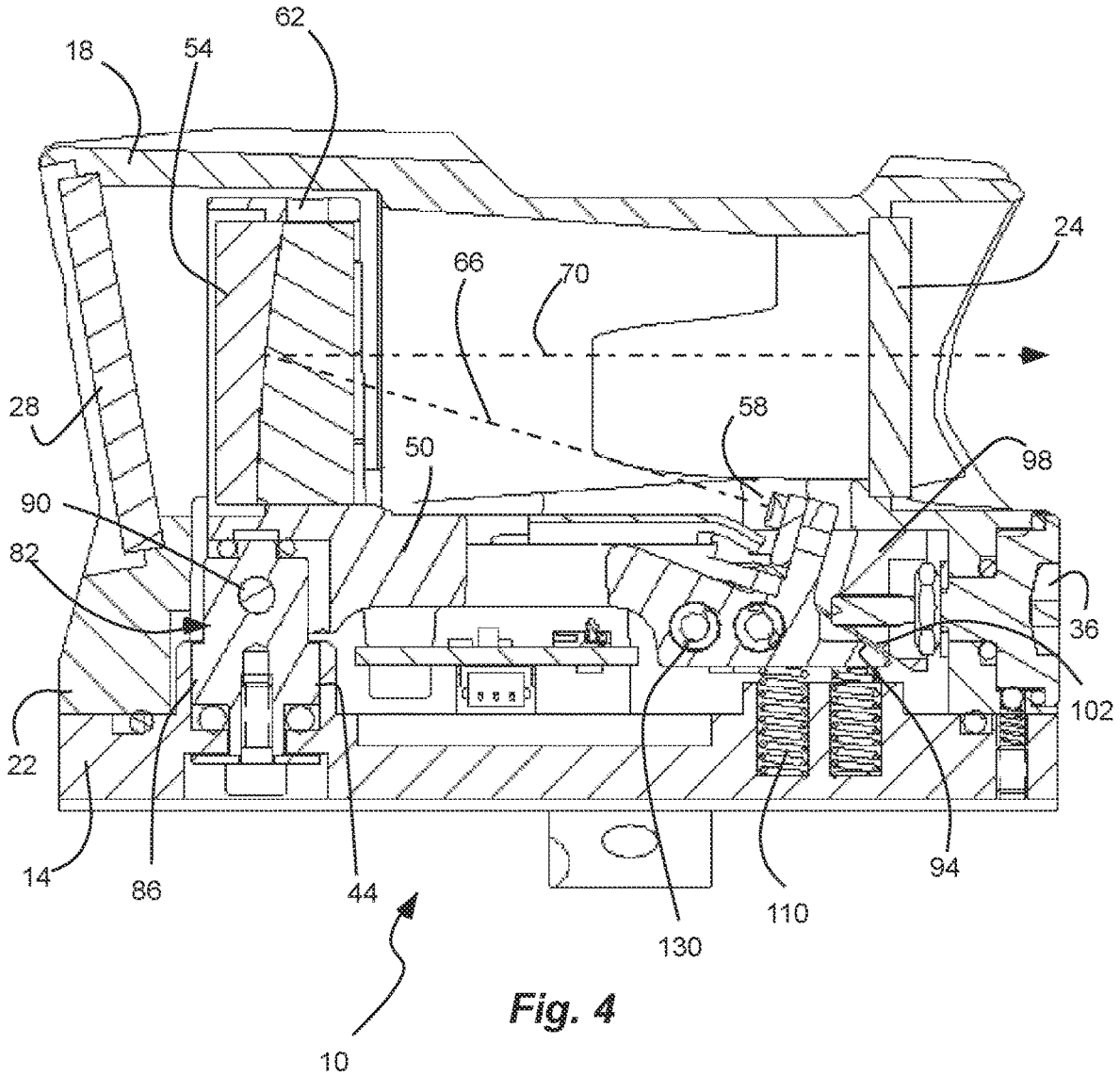
FIG. 4 is a cross-sectional side view of the reflex sight of FIG. 1, taken along line 4 of FIG. 1.

FIG. 3 depicts a partial exploded view of the reflex sight 10, with the shroud removed to expose the frame 50. FIG. 4 depicts a cross-sectional side view of the reflex sight 10. As indicated above, the shroud 18 and the base 14 can form and define a housing 22. The reflex sight 10 also comprises the frame 50 coupled to, disposed on, and/or carried by the base 14. The frame 50 carries a mirror 54 and an illumination source (e.g., a diode or light emitting diode (LED)) 58 spaced-apart from one another, and in a fixed relationship with respect to one another, and with the illumination source 58 directed towards the mirror 54 at a fixed orientation. Although various types of illumination sources are contemplated for use, which will be apparent to those skilled in the art, for purposes of discussion, the example illumination source discussed herein will comprise an LED. The mirror 54 and the LED 58 can be disposed at or near opposite ends of the frame 50. The LED 58 can be disposed at a leading end of the frame 50, or the end through which the user looks, while the mirror 54 can be disposed at a trailing end of the frame, or the end that faces a field of view and/or the target. The frame 50, the mirror 54 and the LED 58 can be disposed in the housing 22 and/or the shroud 18.

The mirror 54 can be a partially reflective window or lens. The mirror 54 can be a mostly clear curved glass reflector. The mirror 54 can be formed by a pair of windows, lenses or optics joined together with a curved or angled interface, or both. Thus, the mirror 54 can be substantially transparent or clear so that a field of view or target is viewable therethrough, while reflecting (indicated by dashed line 70) a reticle 60 (FIG. 10) projected (indicated by dashed line 66) by the LED 58.

Figure 5:
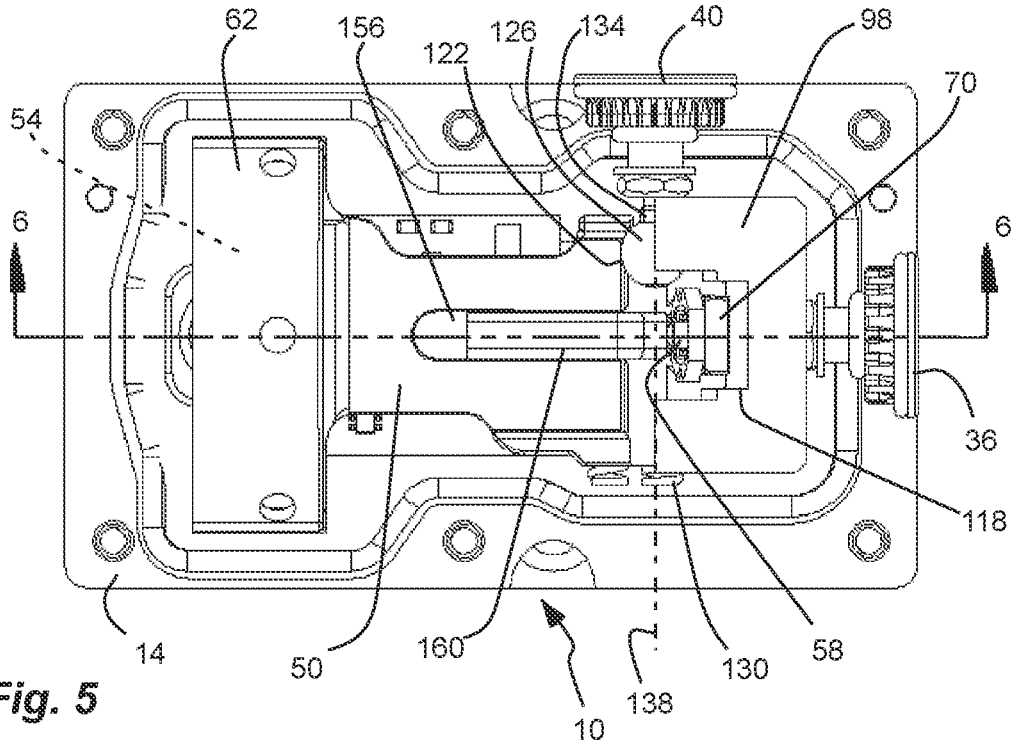
FIG. 5 is a partial top view of the reflex sight of FIG. 1, shown with a shroud removed to expose the frame carried on the base.

FIG. 5 depicts a partial top view of the reflex sight 10, shown with the shroud 18 removed from the base 14 to expose the frame 50 carried on the base 14. The mirror 54 can be held in an arch 62 extending from the frame 50. In one aspect, the mirror 54 can be secured with adhesive. In another aspect, set screws can extend through holes in the arch to secure the mirror 54 in the arch 62. These examples for securing the mirror 54 are not intended to be limiting in any way.

Figure 6:
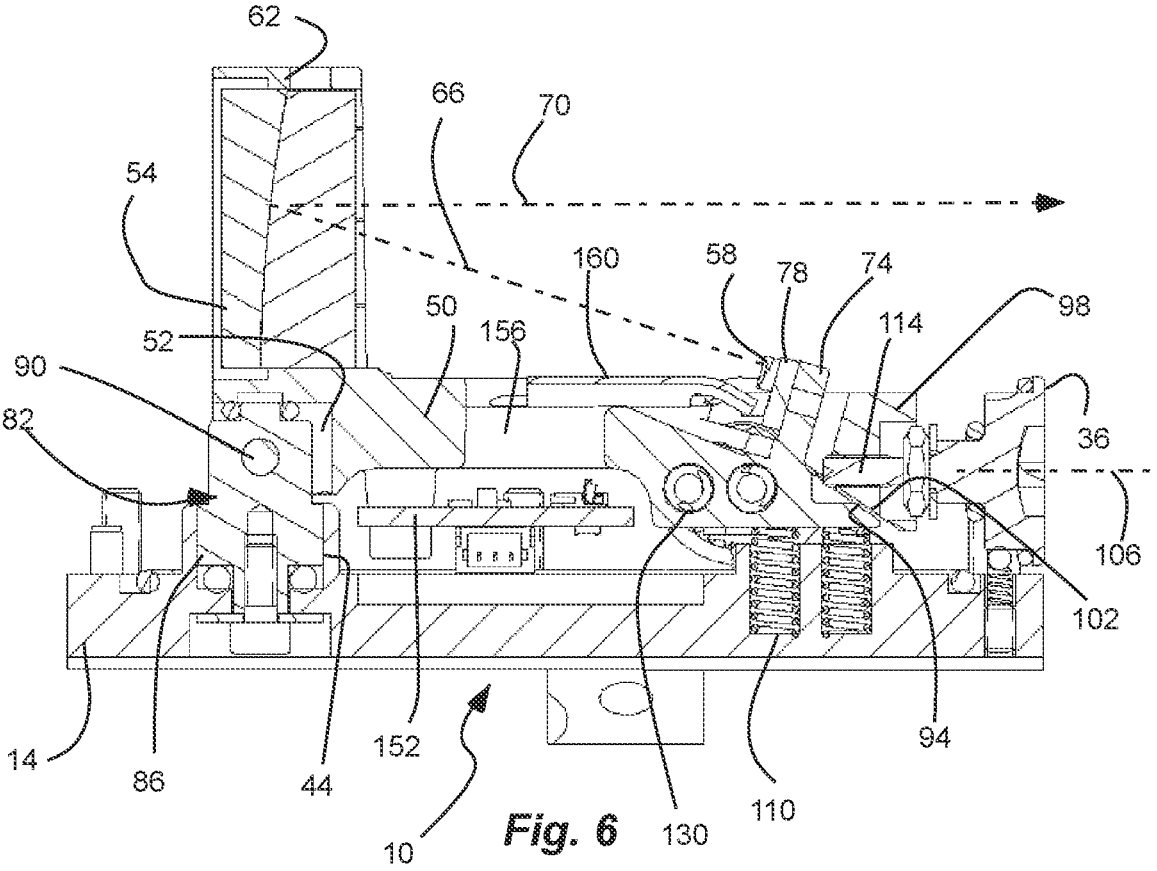
FIG. 6 is a partial cross-sectional side view of the reflex sight of FIG. 1, taken along line 6 of FIG. 5, and shown with the shroud removed to expose the frame carried by the base.

FIG. 6 depicts a partial cross-sectional side view of the reflex sight 10, shown with the shroud 18 removed from the base 14 to expose the frame 50 carried by the base 14. The LED 58 can project (indicated by dashed line 66) a reticle 60 (FIG. 10) towards the mirror 54, which is reflected (indicated by dashed line 70) by the mirror 54 back towards the user. Thus, the reticle appears superimposed upon the field of view and/or the target being viewed by the user through the mirror 54, and thus the reflex sight 10.

The LED 58 can be carried by a post 74 or other structural component or member extending from the frame 50. The post 74 can be oriented at an angle or incline with respect to the mirror 54, or can have an angled or inclined surface, so that the LED 58 is directed towards or faces the mirror 54. In addition, the LED 58 can be mounted on a PCB 78, which in turn is mounted on the post 74 and/or the frame 50. In one aspect, the LED 58 and/or the PCB 78 is adhered to the post 74. As indicated above, the LED 58 and the mirror 54 can be initially aligned and mounted to the single frame 50 from datum or through active alignment, as described in greater detail below. In one aspect, the mirror 54 can be adjusted in the arch 62 until the reticle from the LED 58 is properly aligned 54 on the mirror, and then secured with adhesive or set screws. In another aspect, the PCB 78 can be adjusted on the post 74 until the reticle from the LED 58 is properly aligned on the mirror 54, and then secured with adhesive. In another aspect, both the mirror 54 and the PCB 78 can be adjusted until proper alignment is achieved.

Referring again to FIGS. 2, 3 and 6, the reflex sight 10 also comprises a spindle 82 about which an orientation of the frame 50 with respect to the base 14 is adjusted. As described above, the mirror 54 and the LED 58 are in a fixed relationship with respect to one another on the frame 50, and thus alignment with the weapon is achieved by adjusting the frame 50 with respect to the base 14, namely about the spindle 82. The spindle 82 is carried by the frame 50, and disposed between the frame 50 and the base 14. The spindle 82 comprises a vertical shaft 86 extending between the base 14 and the frame 50. A bottom end of the vertical shaft 86 of the spindle 82 is pivotally disposed in the spindle bore 44 of the base 14, as shown in FIG. 6. Thus, the frame 50 is capable of swiveling horizontally on the vertical shaft 86 to adjust for azimuth (or windage). The bottom of the vertical shaft 86 of the spindle 82 can be secured to the base 14 by a screw extending through the base 14 and into the vertical shaft 86. An o-ring, wave or Belleville-style washer, washer, gasket, annular bearing, or combinations thereof, can be disposed in the spindle bore 44, between a bottom of the vertical shaft 86 and a bottom of the spindle bore 44. An o-ring, wave or Belleville-style washer, washer, gasket, annular bearing, annular bearing, or combinations thereof, can be disposed on either end of the spindle 82 to load the joints of the mechanism to reduce play. A lower o-ring or the like can also form a seal.

An upper end of the vertical shaft 86 of the spindle 82 is received in the yoke 52 of the frame 50. In addition, the spindle 82 comprises a horizontal axle 90 extending between the vertical shaft 86 and the frame 50. The horizontal axle 90 extends through the yoke 52 and the upper end of the vertical shaft 86, such as through a horizontal bore extending through the yoke 52 and the vertical shaft 86. The frame 50 is vertically pivotal on the horizontal axle 90 to adjust for elevation. Another o-ring or annular bearing can be disposed on top of the vertical shaft 86, and between the vertical shaft 86 and the yoke 52 of the frame 50.

The spindle 82 can be disposed at one end, such as the trailing end, of the frame 50 and the reflex sight 10. Thus, the leading end of the frame 50 can be moved or adjusted. The yoke 52 can be positioned underneath the mirror 54 and the arch 62 thereof. Thus, the spindle 82 can be located underneath the mirror 54, at the tailing end of the frame 50. Adjustment mechanisms, as described in greater detail hereafter, can be disposed at the leading end of the frame. Locating the spindle 82 and the adjustment mechanisms at opposite ends of the frame 50 allows for the greatest adjustment with the least amount of movement.

Figure 7:
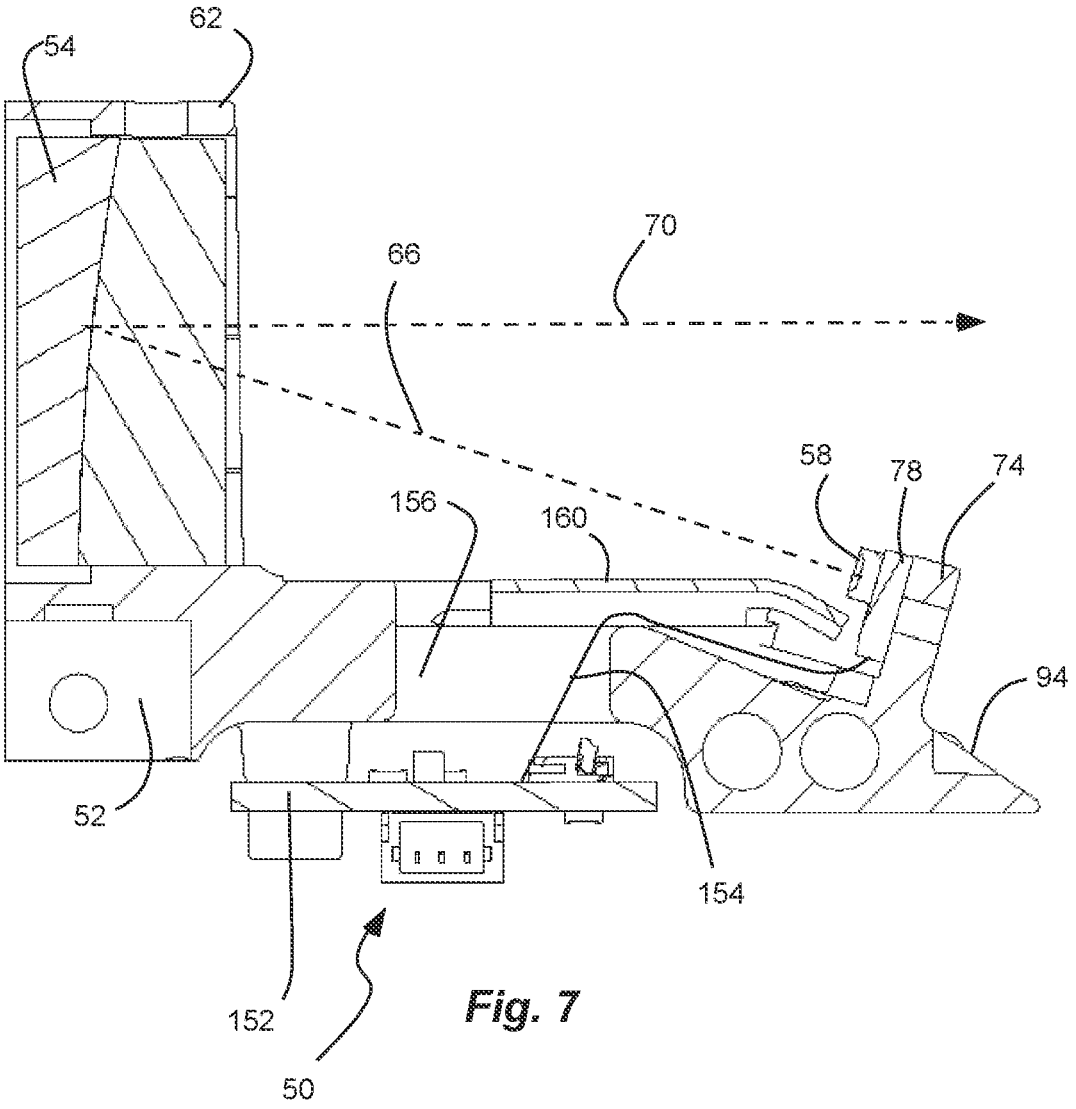
FIG. 7 is a cross-sectional side view of the frame of the reflex sight of FIG. 1, shown with the shroud and the base removed.

FIG. 7 depicts a cross-sectional side view of the frame 50 of the reflex sight 10, shown with the shroud 18 and the base 14 removed. The reflex sight 10 can have an elevation adjustment to adjust the elevation of the reflex sight with respect to the weapon. The elevation adjustment can comprise an inclined surface 94 at the leading end of the frame 50. The inclined surface 94 can be oriented at an acute angle with respect to the frame 50. The inclined surface 94 can define a cam surface which can be acted upon to move the leading end of the frame up or down about the spindle 82 or the horizontal axle 90 thereof.

Referring again to FIGS. 2-6, the elevation adjustment can comprise a wedge 98. The wedge 98 can be carried by and/or coupled to the shroud 18, as shown in FIGS. 2 and 4. The wedge 98 has an oppositely inclined surface 102 (FIG. 2) slidably bearing against the inclined surface 94 of the frame 50, as shown in FIG. 6. The wedge 98 can be displaceable along a first axis 106 (FIG. 6) that extends through the inclined surfaces 94 and 102 of the frame 50 and the wedge 98, respectively. Displacing the wedge 98 displaces the end of the frame 50 vertically, up or down, and in a direction transverse to the first axis. One or more springs 110 can be disposed between the base 14 and the frame 50 at the leading end, and under the inclined surface 94 of the frame 50, to bias the leading end of the frame 50 in an upward direction. Driving or extending the wedge 98 forward, or towards the frame 50, pushes the leading end of the frame 50 downwardly against the springs. Retracting the wedge 98 rearward, or away from the frame 50, allows the leading end of the frame 50 to be pushed upwardly by the springs.

As indicated above, the reflex sight 10 can have an elevation adjustment knob 36 carried by the housing 22 and the shroud 18. The knob 36 can have a threaded axle 114 extending therethrough and threadably engaging the wedge 98. Thus, turning the elevation adjustment knob 36 can extend and retract the wedge 98, lowering and raising the leading edge of the frame 50, and raising and lowering the reticle and the reflex sight 10.

Referring again to FIGS. 6 and 7, in one aspect, the post 74 can intersect the inclined surface 94 of the frame 50. Locating the post 74 on the inclined surface 94 can help create a compact design of the reflex sight 10, particularly for small arms. Referring again to FIGS. 2 and 5, a notch 118 can be formed in a distal end of the wedge 98 that can receive the post 74 therein. Again, having the wedge 98 receive the post 74 can contribute to the compact design of the reflex sight 10.

Referring again to FIG. 3, one or more roller or cylindrical bearings or pins 120 can be disposed in one or more corresponding bores 121 formed in the frame 50 at the leading end, and extending into the inclined surface 94. Thus, the opposite inclined surface 102 of the wedge 98 can roll along the roller or cylindrical bearings 120 carried by the frame 50 and the inclined surface 94. The cylindrical bearings or pins 120 can create a tangent contact with the wedge 98. The tangent contact is tolerant to windage movements within an acceptable limit. The cylindrical bearings or pins can provide a high level of accuracy by eliminating the interference effects of tilting one planar surface against another. The bores can be precisely positioned at low cost.

Figure 8:
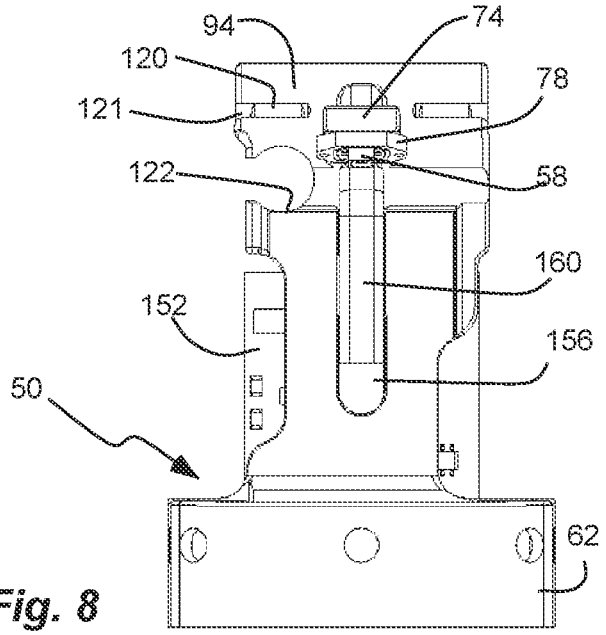
FIG. 8 is a top view of the frame of the reflex sight of FIG. 1, shown with the shroud and the base removed.
Figure 9:
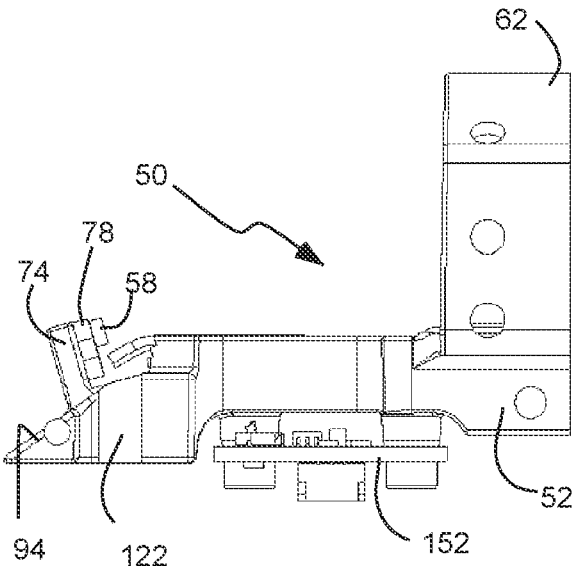
FIG. 9 is a side view of the frame of the reflex sight of FIG. 1, shown with the shroud and the base removed.

FIG. 8 depicts a top view of the frame 50 of the reflex sight 10. The roller or cylindrical bearings 120 are shown disposed in the bores 121 that extend into the inclined surface 94. FIG. 9 depicts a side view of the frame 50 of the reflex sight 10. The reflex sight 10 can have an azimuth adjustment to adjust the azimuth or windage of the reflex sight with respect to the weapon. A vertical bore 122 can extend through the leading end of the frame 50.

Referring again to FIGS. 2 and 5, the azimuth adjustment can further comprise a barrel 126 slidably disposed in the vertical bore 122 of the frame 50. The leading end of the frame 50 can displace vertically with respect to the barrel 126 during elevation adjustment, as described above. One or more springs 130 can be disposed between the frame 50 at the leading end and the housing 22, or the base 14 or the shroud 18, to bias the leading end of the frame in one lateral direction.

As indicated above, the reflex sight 10 can have an azimuth adjustment knob 40 carried by the housing 22 and the shroud 18. The knob 40 can have a threaded axle 134 (FIG. 2) extending therethrough and threadably engaging the barrel 126. The barrel 122 can be displaceable along a second axis 138 (FIG. 5), transverse to the first axis 106 (FIG. 6), to displace the leading end of the frame 50 laterally in a direction along the second axis 138. Thus, turning the azimuth adjustment knob 40 can extend and retract the barrel 126, displacing the leading edge of the frame 50 back and forth. The barrel also is tolerant to the tilting action or effect of the elevation movement.

In one aspect, the vertical bore 122 can intersect the inclined surface 94 of the frame 50. Locating the vertical bore 122 to intersect the inclined surface 94 can help create a compact design of the reflex sight 10, particularly for small arms. Referring again to FIG. 2, a cut-out 142 can be formed in a distal end of the wedge 98 and can receiving the barrel 122 therein. Again, having the wedge 98 receive the barrel 122 can contribute to the compact design of the reflex sight 10.

Figure 10:
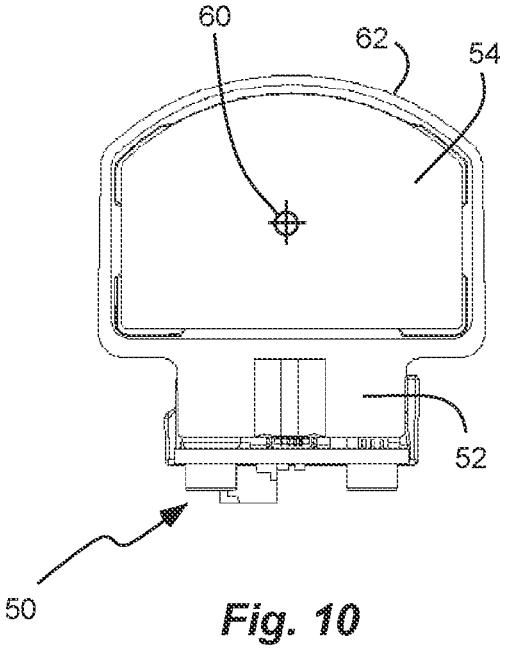
FIG. 10 is a front view of the frame of the reflex sight of FIG. 1, shown with the shroud and the base removed.

FIG. 10 depicts a front view of the frame 50 of the reflex sight 10. The reticle 60 can be projected on the mirror 54.

In one aspect, the frame 50 can be formed of metal, and can be formed by machining. In another aspect, the frame 50 can be formed by casting or molding.

Figure 11:
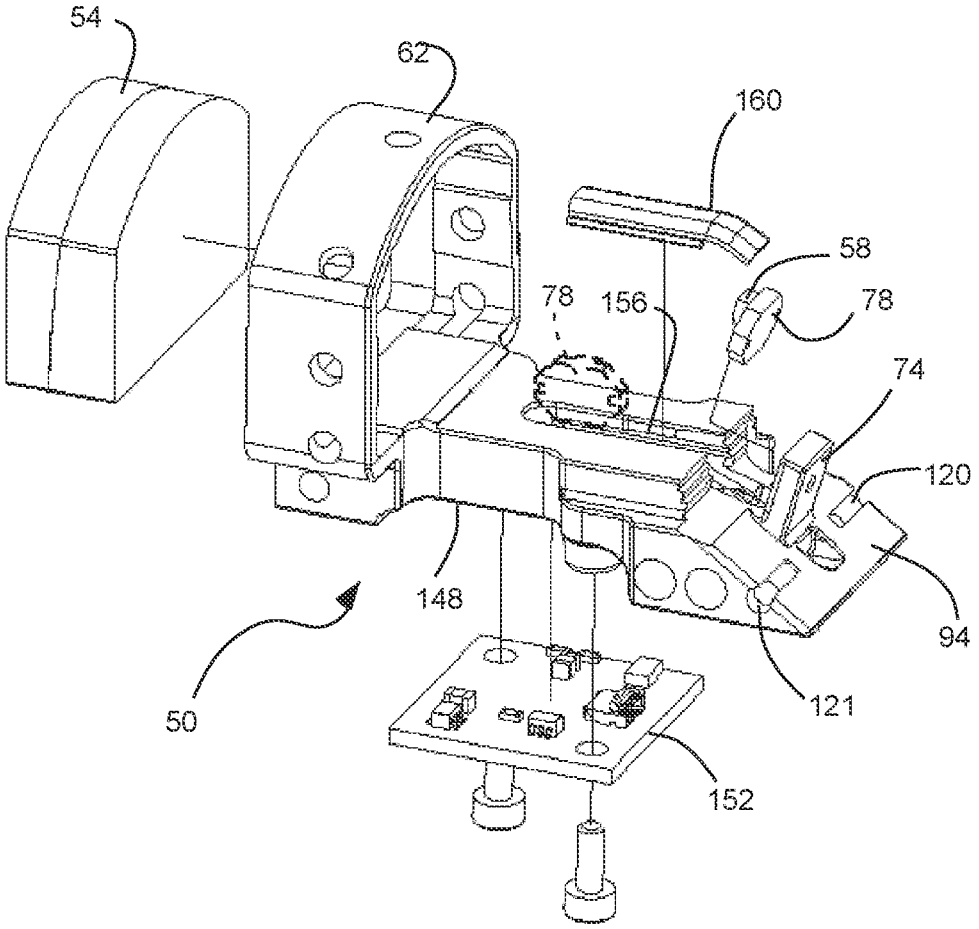
FIG. 11 is an exploded perspective view of the frame of the reflex sight of FIG. 1, shown with the shroud and the base removed, and also showing a method of fabricating the frame of the reflex sight.

FIG. 11 depicts an exploded perspective view of the frame 50 of the reflex sight 10. Referring to FIGS. 7 and 11, in one aspect, the frame 50 can have an indentation 148 formed therein, opposite the recess 48 in the base. A PCB 152 can be disposed in the indentation 148 of the frame 50. The PCB 152 can be affixed to and carried by the frame 50 in the indentation 148. The PCB 152 can carry electronics to control the LED 58 and the reticle projected thereby. Thus, the PCB 152 can be electrically coupled, such as by wires 154 (FIG. 7) to the LED 58 or the PCB 78 carrying the LED 58. A slot 156 can be formed in the frame 50, and can extend through the frame 50 to the indentation 148. The electrical connection 154 can extend from the PCB 152, through the slot 156, to the LED 58, as shown in FIG. 7. The slot 156 can be sized to receive the LED 58 and associated PDB 78 therethrough, such as during manufacture, indicated by dashed lines in FIG. 11. A cap 160 can cover the slot 156.

Referring again to FIG. 4, in one aspect, the reflex sight 10 can be a closed sight. The shroud 18 can be disposed over the frame 50, the mirror 54 and the LED 58. The shroud 18 can be carried by the base 14 to form the housing 22. The housing 22 can be sealed with the shroud 18 sealed to the base 14, and the open opposite ends of the shroud 18 sealed by the lenses 24 and 28.

In another aspect, the frame 50, the mirror 54 and the LED 58 can be exposed above the base 14, defining an open sight, represented by FIG. 6.

A method for manufacturing the reflex sight comprises: securing a mirror 54 to a frame 50, such as in the arch 62; positioning an LED 58 opposing the mirror 54, such as on the post 74; activating the LED 58 to direct a beam from the LED towards the mirror 54; aligning the beam from the LED 58 with respect to the mirror 54, while the LED 58 is activated and the reticle is projected on the mirror 54; and fixing the LED 58 and/or the mirror 54 to the frame 50 while aligned. In addition, the method can further comprise inserting the LED 58, and associated PCB 78, through a slot 156 in the frame 50 prior to positioning; and capping the slot 156 with a cap 160.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

Although the disclosure may not expressly disclose that some embodiments or features described herein may be combined with other embodiments or features described herein, this disclosure should be read to describe any such combinations that would be practicable by one of ordinary skill in the art. The user of "or" in this disclosure should be understood to mean non-exclusive or, i.e., "and/or," unless otherwise indicated herein.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A reflex sight device configured to sight a weapon, the device comprising:

a base configured to be mounted to the weapon;

a frame carried by the base;

a mirror carried by the frame;

an illumination source carried by the frame, and spaced-apart and in a fixed relationship with respect to the mirror, with the illumination source directed towards the mirror at a fixed orientation; and a spindle carried by the frame and disposed between the frame and the base for facilitating azimuth adjustment and elevation adjustment of the frame with respect to the base;

wherein the spindle comprises a shaft extending between the base and the frame, with the frame capable of swiveling on the shaft to facilitate azimuth adjustment, and wherein the spindle comprises an axle extending between the shaft and the frame with the frame pivotal on the axle to facilitate elevation adjustment.

2. The device of claim 1, wherein the shaft comprises a vertical shaft, and the axle comprises a horizontal axle, the device further comprising:

a spindle bore formed in the base;

a bottom end of the vertical shaft of the spindle pivotally disposed in the spindle bore of the base;

a yoke formed in the frame and receiving an upper end of the vertical shaft of the spindle; and the horizontal axle extending through the yoke and the upper end of the vertical shaft.

3. The device of claim 1, wherein the spindle is located underneath the mirror.

4. The device of claim 1, further comprising an elevation adjustment comprising:

an inclined surface at an end of the frame oriented at an acute angle with respect to the frame;

a wedge with an oppositely inclined surface slidably bearing against the inclined surface of the frame; and the wedge being displaceable along a first axis extending through the inclined surfaces of the frame and the wedge to displace the end of the frame vertically in a direction transverse to the first axis.

5. The device of claim 4, further comprising:

a shroud carried by the base and defining a housing, with the frame, the mirror and the illumination source disposed therein; and the wedge being carried by the shroud.

6. The device of claim 5, further comprising:

an elevation adjustment knob carried by the housing and having a threaded axle extending therethrough and threadably engaging the wedge.

7. The device of claim 4, further comprising:

a post extending from the frame and carrying the illumination source;

the post intersecting the inclined surface; and a notch formed in the distal end of the wedge and receiving the post therein.

8. The device of claim 4, further comprising an azimuth adjustment comprising:

a vertical bore extending through the end of the frame;

a barrel slidably disposed in the vertical bore of the frame, with the end of the frame displaceable vertically with respect to the barrel during elevation adjustment; and the barrel being displaceable along a second axis, transverse to the first axis, to displace the end of the frame laterally in a direction along the second axis.

9. The device of claim 8, further comprising:

a shroud carried by the base and defining a housing with the frame, the mirror and the illumination source disposed therein; and an azimuth adjustment knob carried by the housing and having a threaded axle extending therethrough and threadably engaging the barrel.

10. The device of claim 1, wherein the frame, the mirror and the illumination source are exposed above the base, defining an open sight.

11. The device of claim 1, further comprising:

a shroud carried by the base and defining a housing with the frame, the mirror and the illumination source disposed therein, and defining a closed sight;

the shroud having open opposite ends closed by lenses.

12. The device of claim 11, wherein the housing is sealed with the shroud sealed to the base and the open opposite ends of the shroud sealed by the lenses.

13. The device of claim 1, further comprising:

an indentation formed in a bottom of the frame;

a PCB disposed in the indentation of the frame;

a slot formed in the frame and extending through the frame to the indentation, the slot being sized to receive the illumination source therethrough; and an electrical connection extending from the PCB, through the slot, to the illumination source.

14. The device of claim 13, further comprising a cap covering the slot.

15. The device of claim 1, wherein the illumination source comprises a light emitting diode (LED).

16. The device of claim 5, further comprising a seal disposed between the base and the shroud to seal the base and the shroud.

17. The device of claim 1, wherein the mirror is partially transparent such that at least one of a field of view or a target is viewable therethrough.

18. The device of claim 17, wherein the mirror is partially reflective so as to facilitate reflection of a reticle projected by the illumination source, such that the reticle appears superimposed onto at least one of the field of view or the target.

* * * * *